US009033455B2

(12) United States Patent
Isoda

(10) Patent No.: US 9,033,455 B2
(45) Date of Patent: May 19, 2015

(54) SHEET ATTRIBUTION DETECTION SENSOR DEVICE, PAPER SHEET ATTRIBUTION DETECTION METHOD, AND IMAGE FORMING APPARATUS

(71) Applicant: KYOCERA Document Solutions Inc., Osaka (JP)

(72) Inventor: Keisuke Isoda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/336,433

(22) Filed: Jul. 21, 2014

(65) Prior Publication Data

US 2015/0029257 A1 Jan. 29, 2015

(30) Foreign Application Priority Data

Jul. 26, 2013 (JP) ..... 2013-156133

(51) Int. Cl.
*B41J 29/393* (2006.01)
*B41J 11/00* (2006.01)

(52) U.S. Cl.
CPC ..... *B41J 11/009* (2013.01)

(58) Field of Classification Search
CPC .... B41J 29/393; B41J 2/17546; B41J 2/0458; B41J 2/0451; B41J 2/2135
USPC ..... 347/19, 14, 16, 106
See application file for complete search history.

(56) References Cited

U.S. PATENT DOCUMENTS

| | | | | |
|---|---|---|---|---|
| 5,844,682 | A * | 12/1998 | Kiyomoto et al. | 356/237.1 |
| 6,335,501 | B1 * | 1/2002 | Khalfan | 209/582 |
| 2009/0142082 | A1 * | 6/2009 | Ferran et al. | 399/45 |

FOREIGN PATENT DOCUMENTS

| | | | |
|---|---|---|---|
| JP | 10-198174 | A | 7/1998 |
| JP | 2000-275167 | A | 10/2000 |

* cited by examiner

*Primary Examiner* — Manish S Shah
*Assistant Examiner* — Yaovi Ameh
(74) *Attorney, Agent, or Firm* — Stein IP, LLC

(57) ABSTRACT

A sheet attribution detection sensor device includes a light emission element configured to emit incident light to a paper sheet, a light receiving element configured to receive a specular reflection component of reflection light from the paper sheet of the incident light in order to specify a thickness of the paper sheet, and light receiving elements configured to receive a diffuse reflection component of the reflection light in order to specify one of surface roughness and color of the paper sheet.

5 Claims, 4 Drawing Sheets

SHEET ATTRIBUTION DETECTION SENSOR DEVICE, PAPER SHEET ATTRIBUTION DETECTION METHOD, AND IMAGE FORMING APPARATUS

CROSS-REFERENCE TO RELATED APPLICATIONS

This application is based upon and claims the benefit of priority from the corresponding Japanese Patent Application No. 2013-156133, filed Jul. 26, 2013, the entire contents of which are hereby incorporated by reference.

BACKGROUND OF THE INVENTION

The present disclosure relates to a sheet attribution detection sensor device, a sheet attribution detection method, and an image forming apparatus.

There is a sheet attribution detection sensor, which uses two reflection type sensors having different incident angles so as to detect whether the sheet is a normal paper sheet or a sheet for an over head projector (OHP).

In addition, there is another sheet attribution detection sensor, which detects a surface state of a printing paper sheet based on a ratio between a transverse electric (TE) wave component and a transverse magnetic (TM) wave component of reflection light.

However, when detecting a plurality of sheet attributions, it is necessary to separately dispose the above-mentioned sensor for each of the sheet attributions. Therefore, the number of elements such as light emission elements used for the sensor is increased, and hence size and cost of the entire sensor are increased.

SUMMARY OF THE INVENTION

A sheet attribution detection sensor device according to the present disclosure includes a light emission element configured to emit incident light to a paper sheet, a first light receiving element configured to receive a specular reflection component of reflection light from the paper sheet of the incident light in order to specify a thickness of the paper sheet, and a second light receiving element configured to receive a diffuse reflection component of the reflection light in order to specify one of sheet surface roughness and paper sheet color.

An image forming apparatus according to the present disclosure includes the above-mentioned sheet attribution detection sensor device, an image output portion configured to print an image on the paper sheet, and a controller configured to control the image output portion based on a plurality of attributions of the paper sheet detected by the sheet attribution detection sensor device.

Further features and advantages of the present disclosure will become more apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Now, an embodiment of the present disclosure is described with reference to the drawings.

Figure 1:
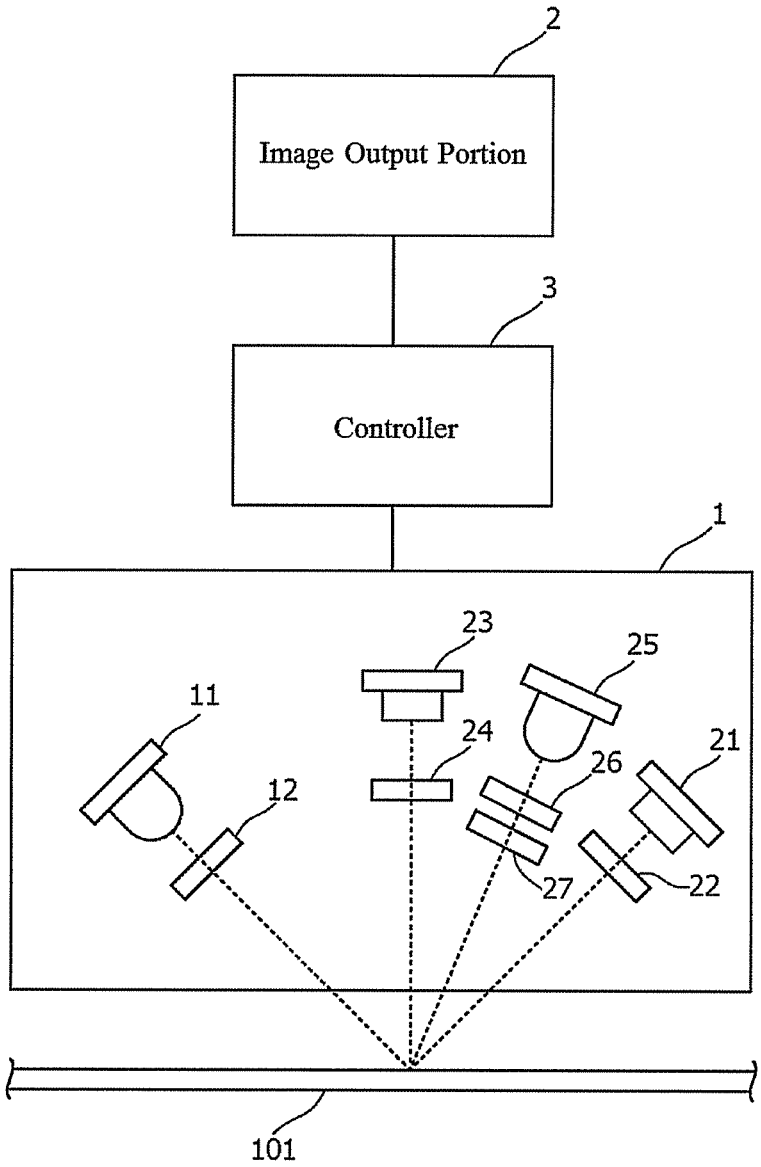
FIG. 1 is a block diagram illustrating a structure of an image forming apparatus according to an embodiment of the present disclosure.

FIG. 1 is a block diagram illustrating a structure of an image forming apparatus according to the embodiment of the present disclosure. The image forming apparatus illustrated in FIG. 1 is a printer, a copy machine, a multifunction peripheral, or the like, and includes a sheet attribution detection sensor device 1 configured to detect a plurality of attribution values of the printing paper sheet, an image output portion 2 configured to print an image on the printing paper sheet, and a controller 3 configured to control the image output portion 2 based on a plurality of attribution values detected by the sheet attribution detection sensor device 1.

In the image forming apparatus, the sheet attribution detection sensor device 1 is disposed at a position opposed to a sheet feed cassette storing paper sheets 101 or a position facing a transport path of the paper sheet 101, so as to detect attributions of the paper sheet 101 other than a size, which include a thickness, a color, and a paper sheet type (rough paper, normal paper, glossy paper, or an OHP sheet) based on permeability and surface roughness. The sheet attribution detection sensor device 1 includes a light emission element 11, a condensing lens 12, a light receiving element 21, a condensing lens 22, a light receiving element 23, a condensing lens 24, a light receiving element 25, a filter 26, and a condensing lens 27.

The light emission element 11 is a light emitting diode, for example, and emits incident light to the paper sheet 101. Light emitted from the light emission element 11 enters the paper sheet 101 via the condensing lens 12 in a spot shape.

The light receiving element 21 is a position sensor, for example, and receives a specular reflection component of reflection light from the paper sheet 101 of the incident light via the condensing lens 22 in order to specify a thickness of the paper sheet 101.

The light receiving element 23 is a color sensor, for example, and receives a diffuse reflection component of the reflection light via the condensing lens 24 in order to specify color of the paper sheet 101.

The light receiving element 25 is a photodiode or a phototransistor, for example, and receives the diffuse reflection component of the reflection light via the filter 26 and the condensing lens 27 in order to specify surface roughness of the paper sheet 101. The filter 26 blocks visible light and transmits infrared light. Thus, an infrared light component of the diffuse reflection component is detected by the light receiving element 25, and a dispersion of a detection value of the light receiving element 25 due to color of the paper sheet 101 is suppressed.

Note that an incident angle of the incident light from the light emission element 11 to the paper sheet may be smaller than 45 degrees. When the incident angle of incident light from the light emission element 11 to the paper sheet is set to be smaller than 45 degrees, it is possible to determine that the paper sheet 101 is an OHP sheet.

The image output portion 2 prints an image on the paper sheet 101. The image output portion 2 transports the paper sheet 101 from the sheet feed cassette, for example, develops a toner image so as to transfer the toner image onto the paper sheet 101 by electrophotography of a direct transfer method or an indirect transfer method, and fixes the toner image onto the paper sheet 101 by a fixing unit. Note that the image output portion 2 may print by an inkjet method.

The controller 3 controls the image output portion 2 based on a plurality of attributions of the paper sheet 101 detected by the sheet attribution detection sensor device 1. In this embodiment, the controller 3 performs control of fixing temperature by the fixing unit, transfer control, transport speed control, development condition setting, and the like based on the detected thickness, surface roughness, and color.

Next, an operation of the image forming apparatus is described.

Before starting transportation or on the transport path, a plurality of attribution values of the paper sheet 101 are simultaneously detected and specified by the sheet attribution detection sensor device 1. Here, the thickness, the color, and the paper sheet type described above are specified.

Specifically, the controller 3 specifies the thickness of the paper sheet 101 and whether or not the paper sheet 101 is an OHP sheet based on an output of the light receiving element 21 of the sheet attribution detection sensor device 1, specifies the color of the paper sheet 101 based on an output of the light receiving element 23, and specifies surface roughness of the paper sheet 101 and whether or not the paper sheet 101 is other than the OHP sheet (rough paper, normal paper, or glossy paper) based on an output of the light receiving element 25.

Figure 2:
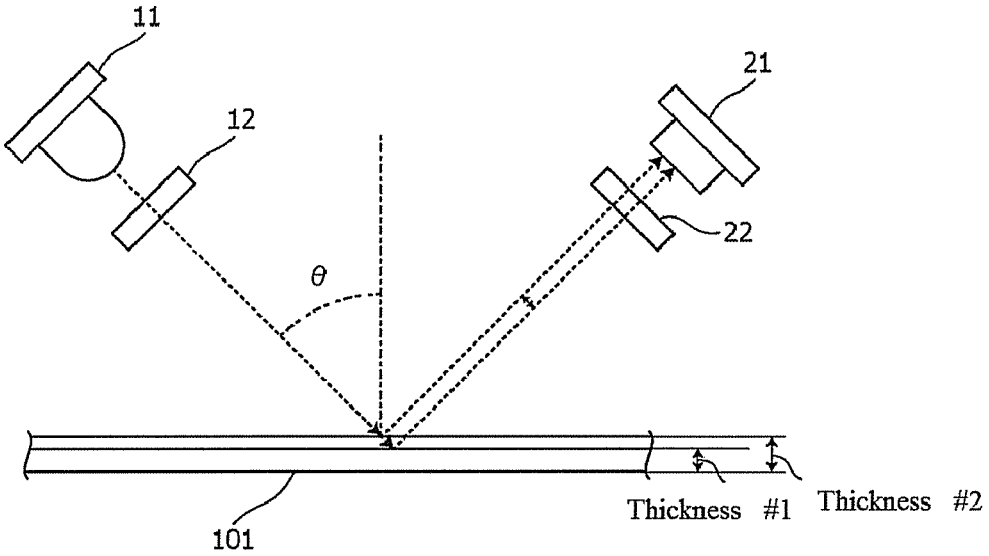
FIG. 2 is a diagram illustrating detection of paper sheet thickness by a light receiving element 21 illustrated in FIG. 1.

FIG. 2 is a diagram illustrating detection of paper sheet thickness by the light receiving element 21 in FIG. 1. As illustrated in FIG. 2, an incident position of the reflection light on the light receiving element 21 is changed in accordance with the thickness of the paper sheet 101, and output current of the light receiving element 21 is changed in accordance with the variation of the incident position. The controller 3 stores data indicating a correspondence relationship between the output current of the light receiving element 21 and the thickness of the paper sheet 101 in advance and specifies the thickness of the paper sheet 101 based on the data from output current of the light receiving element 21.

More specifically, when the light receiving element 21 is a position sensor, this position sensor is a semiconductor position sensor element and is an optical sensor capable of detecting a spot light position. This position sensor has a PIN structure with one junction interface like a photodiode. When light enters the semiconductor surface in a spot shape, electric charge is generated and reaches electrodes on both sides of the sensor. Because an amount of the reaching electric charge is inverse proportional to a distance from the spot position to the electrode, current obtained from the electrode corresponds to the spot position. Therefore, the paper sheet thickness can be specified based on output current of the light receiving element 21. Note that because the output current corresponds to a barycenter position of the spot, the specified paper sheet thickness is not affected by a spot size.

FIG. 3A to 3D are diagrams for illustrating detection of the paper sheet of different colors by the light receiving element 23 illustrated in FIG. 1. When the light receiving element 23 is a color sensor, this color sensor includes a RGB filter and detects the incident light in the visible light range individually for each of R, G, and B color signals. This color sensor has a structure of a combination of three photodiodes of R, G, and B channels, or a combination of one channel photodiode and optical filters of R, G, and B colors.

Figure 3A:
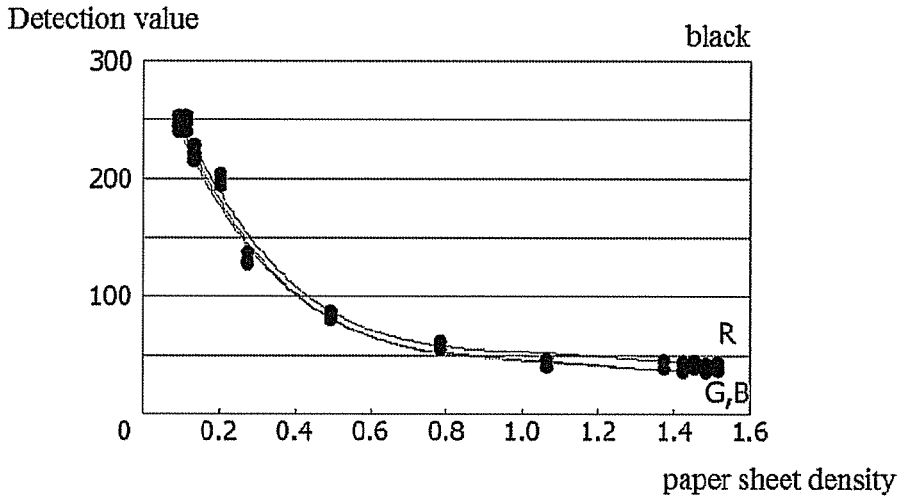
FIG. 3A is a diagram illustrating an example of a relationship between paper sheet density and a color signal value when paper sheet color is black.
Figure 3B:
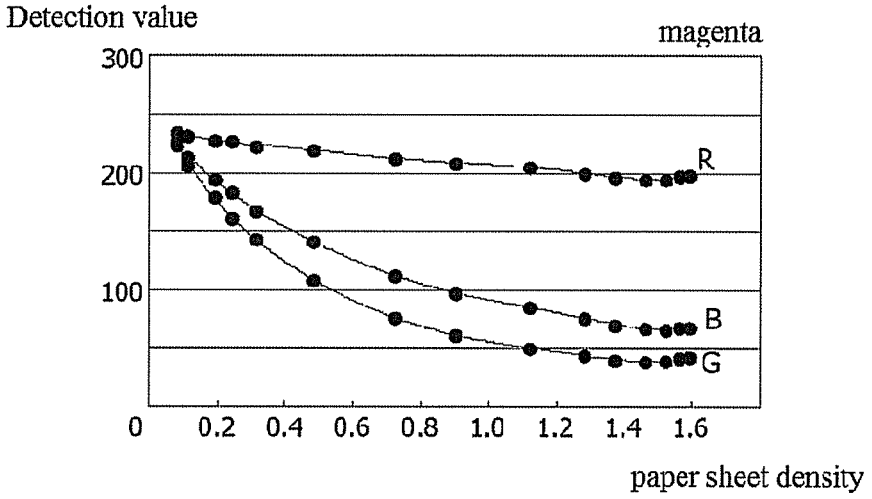
FIG. 3B is a diagram illustrating an example of a relationship between the paper sheet density and the color signal value when the paper sheet color is magenta.
Figure 3C:
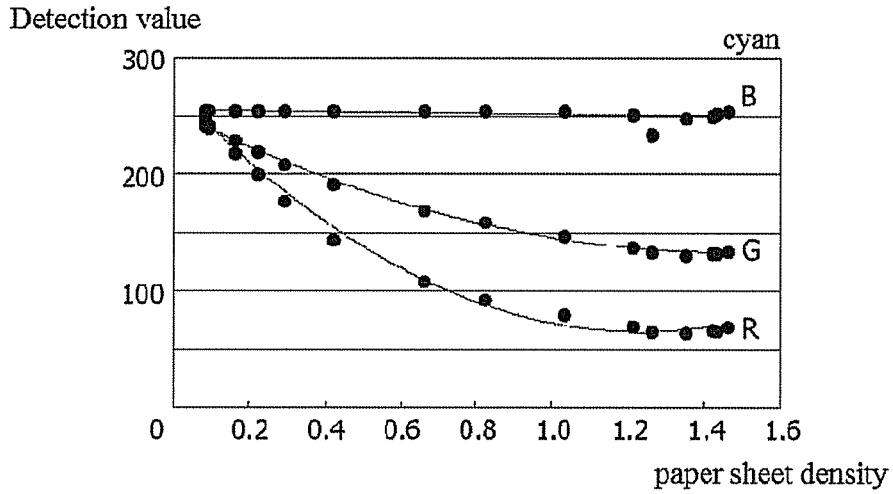
FIG. 3C is a diagram illustrating an example of a relationship between the paper sheet density and the color signal value when the paper sheet color is cyan.
Figure 3D:
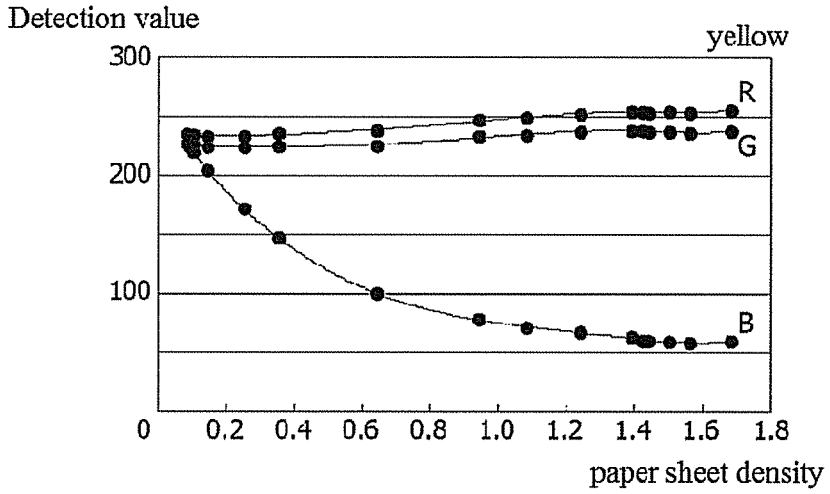
FIG. 3D is a diagram illustrating an example of a relationship between the paper sheet density and the color signal value when the paper sheet color is yellow.

As illustrated in FIG. 3A to 3D, three color signal levels of R, G, B colors obtained from the light receiving element 23 change in accordance with a color of the paper sheet 101. FIG. 3A illustrates an example of a relationship between paper sheet density and a color signal value when a color of the paper sheet 101 is black. FIG. 3B illustrates an example of a relationship between the paper sheet density and the color signal value when the color of the paper sheet 101 is magenta. FIG. 3C illustrates an example of a relationship between the paper sheet density and the color signal value when the color of the paper sheet 101 is cyan. FIG. 3D illustrates an example of a relationship between the paper sheet density and the color signal value when the color of the paper sheet 101 is yellow.

The controller 3 stores data indicating a correspondence relationship between a color signal level of the light receiving element 23 and a color of the paper sheet 101 in advance, and specifies the color of the paper sheet 101 based on the data from the output of the light receiving element 23.

Further, the amount of the infrared light entering the light receiving element 25 is changed in accordance with the surface roughness of the paper sheet 101 so that the output of the light receiving element 25 is changed. Specifically, as the surface of the paper sheet is rougher, the diffuse reflection component is increased. As the surface glossiness is higher, the diffuse reflection component is decreased. The controller 3 stores data indicating a correspondence relationship between the output of the light receiving element 25 and the surface roughness of the paper sheet 101 in advance, and specifies the surface roughness of the paper sheet 101 based on the data from the output of the light receiving element 25.

Further, the controller 3 determines whether or not the paper sheet type of the paper sheet 101 is an OHP sheet from the output current of the light receiving element 21. When the paper sheet 101 is the OHP sheet, because an incident angle theta is smaller than 45 degrees in this embodiment, the incident light passes through the OHP sheet and is not reflected by the same. Therefore, the output current of the light receiving element 21 is lowered. Therefore, when the output current of the light receiving element 21 is lower than a predetermined threshold value, the controller 3 determines that the paper sheet type of the paper sheet 101 is an OHP sheet, and otherwise determines that the paper sheet type of the paper sheet 101 is any one of rough paper, normal paper and glossy paper.

In this way, when the plurality of attribution values of the paper sheet 101 is specified, the controller 3 controls the image output portion 2 based on the attribution values so that an image is printed on the paper sheet 101.

As described above, according to the embodiment, the sheet attribution detection sensor device 1 includes the light emission element 11 configured to emit incident light to the paper sheet 101, the light receiving element 21 configured to receive the specular reflection component of the reflection light from the paper sheet 101 of the incident light in order to specify the thickness of the paper sheet 101, and the light receiving elements 23 and 25 configured to receive the diffuse reflection component of the reflection light in order to specify the surface roughness of the paper sheet 101 and the color of the paper sheet 101.

Thus, the sheet attribution detection sensor device 1 can detect a plurality of sheet attributions of the paper sheet 101 in the image forming apparatus with low cost and small size.

Note that the embodiment described above is a suitable example of the present disclosure, but the present disclosure is not limited to this embodiment and can be modified or changed without deviating from the scope of the spirit of the present disclosure.

The present disclosure can be applied to an image forming apparatus, for example.

What is claimed is:

1. A sheet attribution detection sensor device including:

a light emission element configured to emit incident light to a paper sheet;

a condensing lens configured to condense the incident light emitted from the light emission element into light in a spot shape;

a first light receiving element configured to cause electric charge produced by the light in the spot shape being incident on a semiconductor surface receiving a specular reflection component of reflection light from the paper sheet of the incident light to reach electrodes on both sides of a sensor and detect a position of the incident light in the spot shape based on an amount of the electric charge reaching the electrodes, in order to specify a thickness of the paper sheet;

a second light receiving element configured to detect a diffuse reflection component of the reflection light in a form divided into red, green, and blue color signals in order to specify paper sheet color; and a third light receiving element including a filter configured to block visible light and transmit infrared light out of the diffuse reflection component of the reflection light in order to specify sheet surface roughness.

2. The sheet attribution detection sensor device according to claim 1, wherein an incident angle of the incident light to the paper sheet is smaller than 45 degrees.

3. An image forming apparatus including:

the sheet attribution detection sensor device according to claim 1;

an image output portion configured to print an image on the paper sheet; and a controller configured to control the image output portion based on a plurality of attributions of the paper sheet detected by the sheet attribution detection sensor device.

4. A sheet attribution detection method including:

emitting light in a spot shape as incident light to a paper sheet;

receiving a specular reflection component of reflection light from the paper sheet of the incident light on a semiconductor surface;

detecting a position of the incident light in the spot shape based on an amount of electric charge produced by the light in the spot shape being including on the semiconductor surface and reaching electrodes on both sides of a sensor, to specify paper sheet thickness;

receiving a diffuse reflection component of the reflection light to specify paper sheet color; and receiving the diffuse reflection component of the reflection light to specify sheet surface roughness.

5. The sheet attribution detection method according to claim 4, wherein an incident angle of the incident light to the paper sheet is smaller than 45 degrees.

* * * * *